US005501879A

United States Patent [19]

Murayama

[11] Patent Number: 5,501,879

[45] Date of Patent: Mar. 26, 1996

[54] ABRASION-RESISTANT COATED FIBER STRUCTURE

[75] Inventor: Sadamitsu Murayama, Takatsuki, Japan

[73] Assignee: Teijin Limited, Osaka, Japan

[21] Appl. No.: 243,996

[22] Filed: May 18, 1994

Related U.S. Application Data

[62] Division of Ser. No. 50,876, Apr. 21, 1993, abandoned, which is a continuation of Ser. No. 475,691, Feb. 6, 1990, abandoned.

[30] Foreign Application Priority Data

Feb. 10, 1989 [JP] Japan ..... 1-30005

[51] Int. Cl.[6] ..... B05D 3/02

[52] U.S. Cl. ..... 427/381; 427/389.9; 427/393.5; 428/372; 428/378; 428/395

[58] Field of Search ..... 427/389.9, 393.5, 427/381; 428/372, 378, 395

[56] References Cited

U.S. PATENT DOCUMENTS 4,654,235 3/1987 Effenberger et al. ..... 427/389.9 X

FOREIGN PATENT DOCUMENTS 0136727 4/1985 European Pat. Off. .

*Primary Examiner*—Michael Lusignan
*Attorney, Agent, or Firm*—Burgess, Ryan & Wayne

[57] ABSTRACT

A coated fiber structure having a high abrasion, flexural fatigue, and flame stardant resistance comprises a number of individual fibers having a thermal decomposition point of 230° C. or more, and coating layers covering and fixed to the surfaces of the individual fibers at a surface covering percentage of 35% or more and comprising a fluorine-containing polymer in the form of individual particles provided by heat-treating the polymer on the individual fibers at a temperature of from 60° C. below to 60° C. above the melting point of the polymer.

6 Claims, 6 Drawing Sheets

ABRASION-RESISTANT COATED FIBER STRUCTURE

This is a division of application Ser. No. 08/050,876, filed Apr. 21, 1993, now abandoned, which is a continuation of application Ser. No. 07/475,691, filed Feb. 6, 1990, now abandoned.

BACKGROUND OF THE INVENTION

1. Field of the Invention

The present invention relates to an abrasion resistant coated fiber structure having an excellent resistance to flexural fatigue and a superior flame retardant resistance. More particularly, the present invention relates to an abrasion resistant coated fiber structure in the form of, for example, a belt, cord, rope, thread, woven or knitted fabric or felt (nonwoven fabric), having specific abrasion resistant coating layers formed on surfaces of individual fibers in the structure and exhibiting an excellent resistance to abrasion and flexural fatigue, and a flame retardant resistance.

2. Description of the Related Arts

It is known that fibrous materials usable for forming belts, cords, ropes threads, woven and knitted fabrics or felts (non-woven fabrics) having a satisfactory wear durability, comprise at least one type of fibers selected from polyester fibers, polyamide fibers, water-insolubilized polyvinyl alcohol fibers, wholly aromatic polyamide (aramide) fibers, wholly aromatic polyester fibers, ultra-high molecular weight polyethylene fibers, and optionally for special uses, glass fibers and carbon fibers.

Sometimes, the above-mentioned fibers can be directly converted to a desired fiber structure without applying a surface treatment to the fibers, but in general, to provide a fiber structure having a specific property, the fibers are formed into yarns and the resultant yarns are surface treated with a specific treating material which will effectively impart the specific property to the fibers, before the yarns are converted to the fiber structure. Alternatively, the fibers are directly converted to a precursory fiber structure, followed by applying a specific treatment to the precursory fiber structure to impart a specific property to the surfaces of the fibers.

Also, in general, the fiber structures having a satisfactory wear durability, and thus usable for various purposes, must exhibit, in addition to a high resistance to abrasion, an excellent flexural fatigue and a superior flame retardant resistance.

To satisfy the above mentioned requirements, the fiber structures are treated or impregnated with a treating material so that the surfaces of individual fibers in the fiber structures are covered with a specific surface-coating material.

The surface-coating material for the fibers can be usually selected from, for example, conventional polyurethane resins and silicone resins, the resultant treated fiber structures are utilized for various purposes.

For example, Japanese Examined Patent Publication (Kokoku) No. 62-60511 discloses a fibrous rope in which individual fibers are coated with a mixture of a polyurethane resin, polyethylene oxide, and ethylene-urea compound. Also, Japanese Unexamined Patent Publication (Kokai) No. 60-173,174 discloses a method of enhancing an abrasion resistance of a fibrous belt, in which method a resinous treating material comprising, as a main component, a blocked urethane prepolymer, is applied to a precursory fibrous belt and then heat treated. Further, Japanese Examined Patent Publication No. 1-29909 discloses a method of producing a treated fiber structure by treating a precursory fiber structure with a first treating liquid comprising, as a main compound, a silane type coupling agent, and then with a second treating liquid comprising, as a main component, an ethyleneurea compound.

The above-mentioned treating materials do effectively enhance the abrasion resistance of the fiber structure surface treated or impregnated therewith, but due to recent rapid advances in the uses of the fiber structures in many fields, the properties of the fiber structures must be further enhanced to a higher level. Therefore, the above-mentioned treated or impregnated fiber structures do not always have satisfactory specific properties, for example, abrasion resistance and flexural fatigue resistance.

For example, the conventional para-type aramide fibers have a very high tensile strength of 20 g/d or more, and thus are now widely used when forming various fiber structures for example, belts, cords or ropes. But the para-type aramide fibers are disadvantageous in that, when rubbed together or against a metal article, the fibers are fibrilized and exhibit a lower mechanical strength due to the fibrilization, and thus cannot exhibit the inherent high mechanical strength of the fiber structure.

To overcome the above-mentioned disadvantage, an attempt has been made to provide a fiber structure, for example, belt, cord, rope or felt, having a core portion formed from aramide fibers and surface portions thereof formed from conventional polyamide (nylon 6 or 66) fibers. The resultant composite fiber structure is now in practical use but does not always exhibit satisfactory properties. Especially, the fibrilization of the aramide fibers is not sufficiently prevented by the above-mentioned composite structure. Further, when the composite structure is stretched under a load during practical use, the load is borne only by the core portion thereof having less elongation than the surface portion. For example, the practical mechanical strength of a rope or cord having the above-mentioned composite structure is similar to that of the core portion thereof. Further, when repeatedly flexed (bent), the aramide fibers in the core portion of the composite structure are rubbed together and fibrilized, and thus the mechanical strength thereof cannot be maintained at a high level for a long time.

Recently, when used in the electric and electronic industries, the various fiber structures must have a high flame retardant resistance. Usually, a conventional treating material causes a reduction in the flame retardant resistance of the aramide fibers, and therefore, a conventional surface treated or aramide fiber structure impregnated with the treating material exhibits a lower flame retardant resistance than that of a non-treated aramide fiber structure.

Also, in the composite structure, the surface portion thereof is formed of the conventional organic fibers having a lower flame retardant resistance than that of the aramide fibers, and thus the composite structure exhibits a unsatisfactory flame retardant resistance.

SUMMARY OF THE INVENTION

An object of the present invention is to provide an abrasion resistant coated fiber structure having, in addition to a superior abrasion resistance, an excellent flexural fatigue resistance and flame retardant resistance.

The above-mentioned object can be attained by the abrasion resistant coated fiber structure of the present invention, comprising:

a number of individual fibers having a thermal decomposition temperature of 230° C. or more; and coating layers covering and fixed to the surfaces of the individual fibers at an average surface-covering percentage of 35% or more and comprising a fluorine-containing polymeric material in the form of individual particles which have been provided by applying a heat treatment to the fluorine-containing polymeric material on the individual fiber surfaces, a t a temperature of from 60° C. below to 60° C. above the melting point of the fluorine-containing polymeric material.

The above-mentioned abrasion resistant coated fiber structure can be produced by the process of the present invention, comprising the step of applying a treating liquid of a fluorine-containing polymeric material to a fiber structure comprising a number of individual fibers; drying the resultant layers of the treating liquid formed on the surfaces of the individual fibers; and heat-treating the resultant dried fluorine-containing polymeric material layers on the individual fibers at a temperature of from 60° C. below to 60° C. above the melting point of the fluorine containing polymeric material, to provide coating layers covering and fixed to the surfaces of the individual fibers at an average surface-covering percentage of 35% or more and comprising a number of individual particles of the fluorine-containing polymeric material.

DESCRIPTION OF THE PREFERRED EMBODIMENTS

Figure 1:
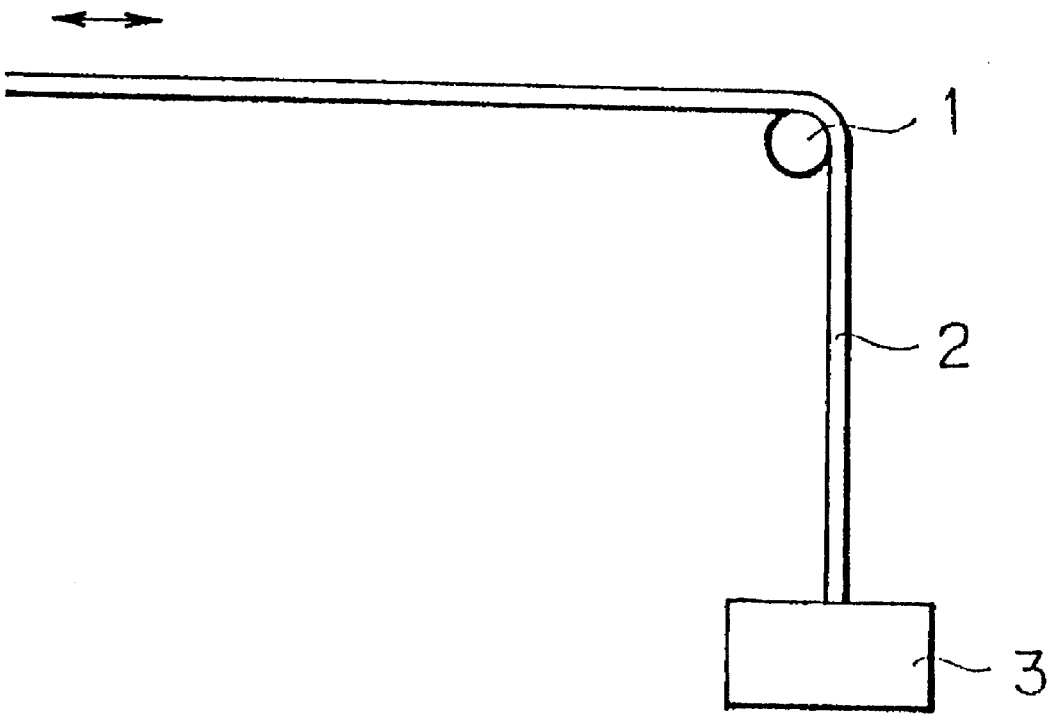
FIG. 1 shows an explanatory side view of a device for testing the abrasion resistance of fibers.

The fiber structures of the present invention include fiber articles in the forms of belts, cords, threads, ropes, woven fabrics, knitted fabrics or felts (nonwoven fabrics). The fiber structures may be selected from composite fiber articles having two or more of the above-mentioned structures.

The fiber structure of the present invention comprises a number of individual fibers and coating layers covering and fixed to the surfaces of the individual fibers.

The individual fibers usable for the present invention have a thermal decomposition temperature of 230° C. or more and are preferably selected from wholly aromatic polyamide (aramide) fibers, wholly aromatic polyester fibers, glass fibers and carbon fibers, more preferably from the aramide fibers and wholly aromatic polyester fibers.

The coating layer comprises a fluorine-containing polymeric material preferably comprising at least one member selected from tetrafluoroethylene polymers, trifluorochloro-ethylene copolymers, tetrafluoroethylene-hexafluoro-propylene copolymers, tetrafluoroethylene-perfluoroalkylvinylether copolymers, tetrafluoroethylene-hexafluoropropylene-perfluoroalkylvinylether copolymers, vinylidene fluoride polymers, and ethylene-tetrafluoroethylene copolymers, more preferably at least one member selected from the group consisting of trifluoroethylene polymers, tetrafluoroethylene polymers and tetrafluoroethylene-hexafluoropropylene copolymers.

The coating layers on the individual fibers have an average surface-covering percentage of 35% or more, more preferably 45% or more.

The fluorine-containing polymeric material in the coating layers is in the form of a number of individual particles and has an appearance like that of a herring roe.

The specific coating layers of the present invention comprising the fluorine-containing polymeric material and having a specific herring roe-like appearance is provided by applying a heat treatment to layers of the fluorine-containing polymeric material formed on the individual fiber surfaces at a temperature of from 60° C. above to 60° C. below the melting point of the fluorine containing polymeric material, preferably from 50° C. above to 50° C. below the melting point.

The coating layers of the present invention can be formed by preparing a treating liquid containing the fluorine-containing polymeric material by dispersing fine solid particles of the polymeric material in a liquid medium, for example, water, or by emulsifying fine particles of a solution of the polymeric material dissolved in a solvent by using an emulsifying agent, in a liquid medium; applying the treating liquid to a fiber structure comprising a number of individual fibers; drying the resultant layers of the treating liquid formed on the individual fiber surfaces; and heat treating the resultant dried fluorine-containing polymeric material layers at a temperature of from 60° C. above to 60° C. below the melting point of the fluorine-containing polymeric material.

The amount of the fluorine-containing polymeric material to be coated on the individual fiber surfaces is preferably 0.5 to 80% by dry weight, more preferably 4 to 70% by dry weight, based on the total dry weight of the individual fibers.

When the amount of the fluorine-containing polymeric material is less than 0.5% by dry weight, the resultant coated fiber structure cannot exhibit a satisfactory abrasion resistance, flexural fatigue resistance and flame retardant resistance. Also, when the amount of the polymeric material is more than 80% by dry weight, the film strength of the resultant polymeric material layers becomes unsatisfactory.

The treating liquid containing the fluorine-containing polymeric material can be applied by any conventional application method, for example, an immersing method, spraying method, coating method or padding method.

The treating liquid layer formed on the fiber structure surface is dried at a predetermined temperature, for example, 80° C. or more, by using a conventional drying apparatus, for example, non-touch dryer or a tenter-type dryer.

The heat-treatment applied to the dried fluorine-containing polymeric material layers effectively forms coating layers covering and fixed to the surfaces of the individual fibers. The heat-treated coating layers comprises a number of individual particles of the fluorine-containing polymeric material firmly fixed to the surfaces of the individual fibers and have a herring roe-like surface appearance.

The individual particles of the fluorine-containing polymeric material firmly fixed to the individual fiber surfaces can prevent close contact of the individual fiber surfaces with each other or with another article, for example, a metallic article, and serve as rollers or runners to reduce friction between the individual fibers or between the individual fibers and another article. Therefore, the coated individual fibers can easily move or slide on another fiber surface or on another article surface. Also, when the coated fiber structure is bent or deformed, the coated individual fibers in the structure can easily move or slide on each other.

For example, when the dried coating layers are made from a tetrafluoroethylene polymer having a melting point of 327° C., the heat treatment for fiber yarns is carried out at a temperature of from 267° C. to 380° C. for 0.5 to 10 minutes. In another example, when a tetrafluoroethylene-hexafluoropropylene copolymer (having a melting point of 270°) is used, the heat treatment for fiber fabrics is carried out at a temperature of from 190° C. to 310° C. for 3 to 20 minutes.

The individual particles of the fluorine-containing polymeric material fixed to the individual fiber surfaces have a herring roe-like appearance and preferably have a size of ⅓ or less the diameter of the individual fibers and preferably from 0.1 to 1 μm.

When the size of the individual particles is less than 0.1 μm, the resultant individual particles cannot serve as rollers or runners, and thus the resultant coated individual fibers exhibit a large friction when rubbed together or against another article.

When the size of the individual particles is more than ⅓ the diameter of the individual fibers, the resultant individual particles cannot be firmly fixed to the individual fibers, and thus exhibit a poor roller or runner effect.

The average surface-covering percentage (SC) of the coating layers is calculated in accordance with the following equation:

$$SC\,(\%) = \frac{A_1}{A_0} \times 100$$

wherein $A_0$ represents an entire peripheral surface area of the individual fibers and $A_1$ represents an average total surface area of portions of the individual fibers covered by the individual particles of the fluorine-containing polymeric material.

In the present invention, the coating layers comprising the herring roe-like individual particles of the fluorine-containing polymeric material have an average surface-covering percentage of 35% to 100%. If the average surface-covering percentage is less than 35%, the resultant coated fiber structure exhibits unsatisfactory abrasion and flexural fatigue resistances.

EXAMPLE

The present invention will be further explained by the following examples.

In the examples, the following tests were carried out.

(1) Abrasion test

The abrasion test device as shown in FIG. 1 was used. In FIG. 1, a fixed abrasion bar 1 formed with a piano wire having a diameter of 0.6 mm or an steel rod having a regular hexagonal cross-sectional profile with a major diameter of 0.6 mm, was fixed at a predetermined position and a specimen 2 to be tested was placed on the abrasion bar 1 in the manner as shown in FIG. 1. A lower end of the specimen was connected to a weight 3 and the other end of the specimen 2 connected to a moving member (not shown) which was moved reciprocally in two opposite directions as shown by the arrows in FIG. 1.

The abrasion test was carried out in the following manner.

(A) A specimen in the form of a cord was connected to a 0.2 g/d weight and reciprocally moved in two opposite directions as shown in FIG. 1 until the specimen was broken due to the abrasion thereof by the abrasion bar. The total number of reciprocal abrasions at which the specimen was broken was measured.

(B) A specimen in the form of a belt was connected to a weight corresponding to 0.1% of the tensile strength of the belt-shaped specimen and reciprocally rubbed 2500 times with the abrasion bar. Thereafter, the specimen was removed from the abrasion bar and subjected to a tensile strength test.

The retention ($R_{AB}$) of tensile strength of the specimen was calculated in accordance with the following equation:

$$R_{AB}\,(\%) = \frac{TS_1}{TS_0} \times 100$$

wherein $TS_0$ represents an original tensile strength of the specimen before the abrasion test and $TS_1$ represents a tensile strength of the specimen after the abrasion test was applied.

(2) Flexural fatigue test

This test was applied to a specimen in the form of a cord. The specimen was bent into an S-shape by two pairs of free rollers.

The S-shaped flexural fatigue operations were repeated 5000 times under conditions such that the ratio (D/d) of the diameter (D) of the free rollers to the diameter (d) of the cord-shaped specimen was from 6.5 to 7.0 and a tension of 0.2 g/d was applied to the specimen. After the bending operations, the tensile strength of the specimen was measured.

The retention $R_{FF}$ of the tensile strength of the flexural fatigued specimen was calculated in accordance with the following equation:

$$R_{FF}\,(\%) = \frac{TS_2}{TS_0} \times 100$$

wherein $TS_0$ represents an original tensile strength of the specimen before the flexural fatigue test and $TS_2$ represent a tensile strength of the specimen after the flexural fatigue test.

(3) Flame retardance test

This test was carried out in accordance with JIS K7201-1972, the oxygen index method. To clarify the differences between the specimens, each specimen in the form of yarns was knitted to provide a tubular knitted fabric, 5 G (needle, 5/inch).

(4) Surface-covering percentage

A photograph of a surfaces of an individual coated fiber at a magnification of 1000 to 5000 was provided by a scanning electron microscope (Trademark: JSM-840, made by Nihon Densi Co.)

The peripheral surface area of a portion of the individual fibers in the photograph was measured. This surface area was represented by A.

In the area A, the total area in which the individual particles of the fluorine-containing polymeric material were distributed at intervals of 20 times or less the size of the particles was measured. This total area was represented by B.

The surface covering percentage SCP of the polymeric material particles was calculated in accordance with the following equation.

$$SCP\ (\%) = \frac{B}{A} \times 100.$$

EXAMPLES 1 AND 2

In each of Examples 1 and 2, a cord-like fiber structure was prepared from aramide multifilament yarns having a yarn count of 1500 denier/1000 filaments available under the trademark of TECHNOLA from Teijin Ltd., in a manner such that two of the yarns were paralleled and doubled, the resultant doubled yarn was twisted in the Z direction at a twisted number of 20 turns/10 cm, and then three of the Z-twisted yarns were united and twisted in the S direction at a twisted number of 20 turns/10 cm. The resultant cord-like fiber structure had a total denier of 9000.

The cord-like fiber structure was fully immersed in a treating liquid containing the type of fluorine-containing polymeric material and in the concentration as indicated in Table 1, and lightly squeezed by a pair of squeezing rollers. The resultant fiber structure impregnated with the treating liquid was dried under the drying conditions (temperature and time) as indicated in Table 1 by using a non-touch drying apparatus, and then heat treated under the heat-treating conditions (temperature and time) as indicated in Table 1, to provide a cord-like coated fiber structure.

The amount of the polymeric material fixed in the coated fiber structure, the average surface-covering percentage of the resultant coating layers, and the abrasion resistance, the flexural fatigue resistance, and the flame retardant resistance of the resultant coated fiber structure are shown in Table 1.

EXAMPLE 3

The same aramide multifilament yarns as those mentioned in Example 1 were fully immersed in an aqueous dispersion containing the same polytetrafluoroethylene as mentioned in Example 1 in the concentration as shown in Table 1, lightly squeezed by squeezing rollers, and dried and heat treated respectively at the temperature and for the time as shown in Table 1.

Two of the coated aramide multifilament yarns were paralleled and doubled and the resultant doubled yarn was twisted at a twist number of 20 turns/10 cm in Z direction. Three of the Z-twisted yarns were united in parallel and twisted at a twist number of 20 turns/10 cm in the S direction to provide a cord structure having a total denier of 9000.

The results of the tests applied to the cord structure in the same manner as mentioned in Example 1 are shown in Table 1.

EXAMPLE 4

The same procedures as mentioned in Example 3 were carried out with the following exceptions.

The aramide multifilament yarns had a yarn count of 200 denier/133 filaments. The aqueous dispersion of polytetrafluoroethylene had the concentration as shown in Table 1. The drying and heat-treating procedures were carried out under the conditions as shown in Table 1.

The cord structure having a denier of 9000 was prepared by uniting in parallel and twisting 15 of the coated aramide multifilament yarns at a twist number of 20 turns/10 cm in the Z direction and then uniting in parallel and twisting three of the Z-twisted coated yarns at a twist number of 20 turns/10 cm in the S direction.

In the flame retardant resistance test, the specimens consisted of a tubular knitted fabric made from coated yarns prepared by uniting in parallel 8 of the coated aramide multifilament yarns and by twisting the resultant paralleled yarns at a twist number of 6 turns/10 cm.

To clarify the relationship between the heat treatment temperature applied to the coated cord structure and the abrasion resistance of the resultant cord structure, a plurality of coated cord structures were prepared in the same manner as mentioned above, except that the heat treatment temperature was varied in range of from 260° C. to 400° C.

The abrasion resistance of each of the resultant heat treated cord structure was measured.

Figure 2:
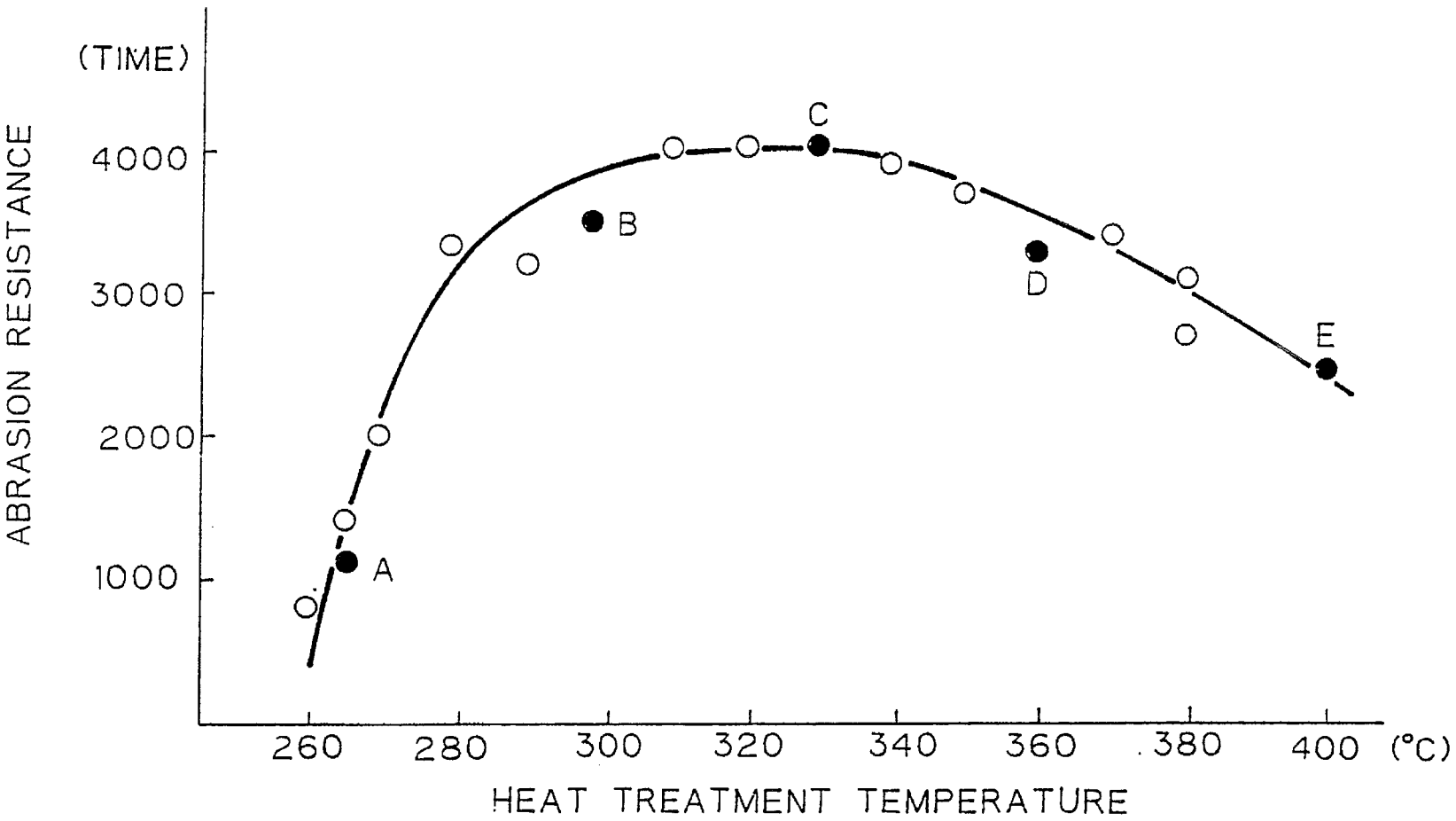
FIG. 2 shows a relationship between a heat treatment temperature applied to a coated fiber structure and an abrasion resistance of the heat treated coated fiber structure.

The results are shown in FIG. 2.

FIG. 2 shows that, when the heat treatment was carried out at the temperature of about 280° C. to about 370° C., the resultant heat treated cord structures exhibited an excellent abrasion resistance.

Referring to FIG. 2, the coated individual fibers corresponding to points A, B, C, D and E provided the electron microscopic views as shown in FIGS. 4A to 4E, taken by the above-mentioned scanning electron microscope at a magnification of 3000.

When the heat treatment was carried out at a temperature of about 265° C., which is 62° C. below the melting point (327° C.) of the polytetrafluoroethylene, the resultant cord structure exhibited an unsatisfactory abrasion resistance, as shown by point A in FIG. 2. In view of FIG. 4A, almost all of the polytetrafluoroethylene in the coating layer was in the form of fine particles and adhered to the individual fiber surfaces. Due to the low heat treatment temperature, however, the individual polytetrafluoroethylene particles adhered to the individual fiber surface exhibited an insufficient adherence to each other and to the individual fiber surfaces, and thus were removed from the fiber surfaces during the abrasion test. When the heat treatment was carried out at a temperature of from about 280° C. (327° C. −57° C.) to about 370° C. (327° C.+53° C.), the resultant cord structures exhibited satisfactory abrasion resistances as represented by points B, C and D in FIG. 2, because the polytetrafluoroethylene in the coating layer was in the form of fine individual particles, firmly fixed to the individual fiber surfaces and had a herring roe-like surface appearance. The firmly fixed individual particles of polytetrafluoroethylene on the individual fiber surfaces served as rollers or runners when the coated cord structures were rubbed with each other or with another article.

When the heat treatment was carried out at a temperature of about 400° C. (327° C.+73° C.), or more, some of the individual particles of polytetrafluoroethylene on the individual fiber surfaces were melted and flattened. Therefore, the number of the individual particles, which can serve as rollers or runners, was decreased. Accordingly, an increase in the heat treatment temperature above the melting point of the polytetrafluoroethylene, causes a gradual lowering of the abrasion resistance of the resultant cord structures, as shown in FIG. 2.

To clarify the relationship between the heat treatment temperature and the peeling strength of the coating layers and the individual fiber surface, a plurality of woven fabrics were produced in the following manner.

The aramide multifilament yarns (200 denier/133 filaments) were converted to plain weaves each having a warp density of 34 yarns/25.4 mm and a weft density of 34 yarns/25.4 mm. The plain weaves were scoured, dried, impregnated with the same aqueous dispersion as in Example 4, having a concentration of polytetrafluoroethylene of 30% by weight, and dried in the same manner as in Example 4.

From each dried fabric, a plurality of specimens having a width of 15 cm and a length of 20 cm were provided. Two specimens were superposed on each other, and the resultant superposed piece was heat-pressed by a pressing machine at a temperature of 260° C. to 400° C. under a pressure of 100 kg/cm$^2$ for 3.0 minutes. The resultant pressed piece was cut to provide test pieces having a width of 2 cm, and the test pieces were subjected to a T-peeling strength measurement.

Figure 3:
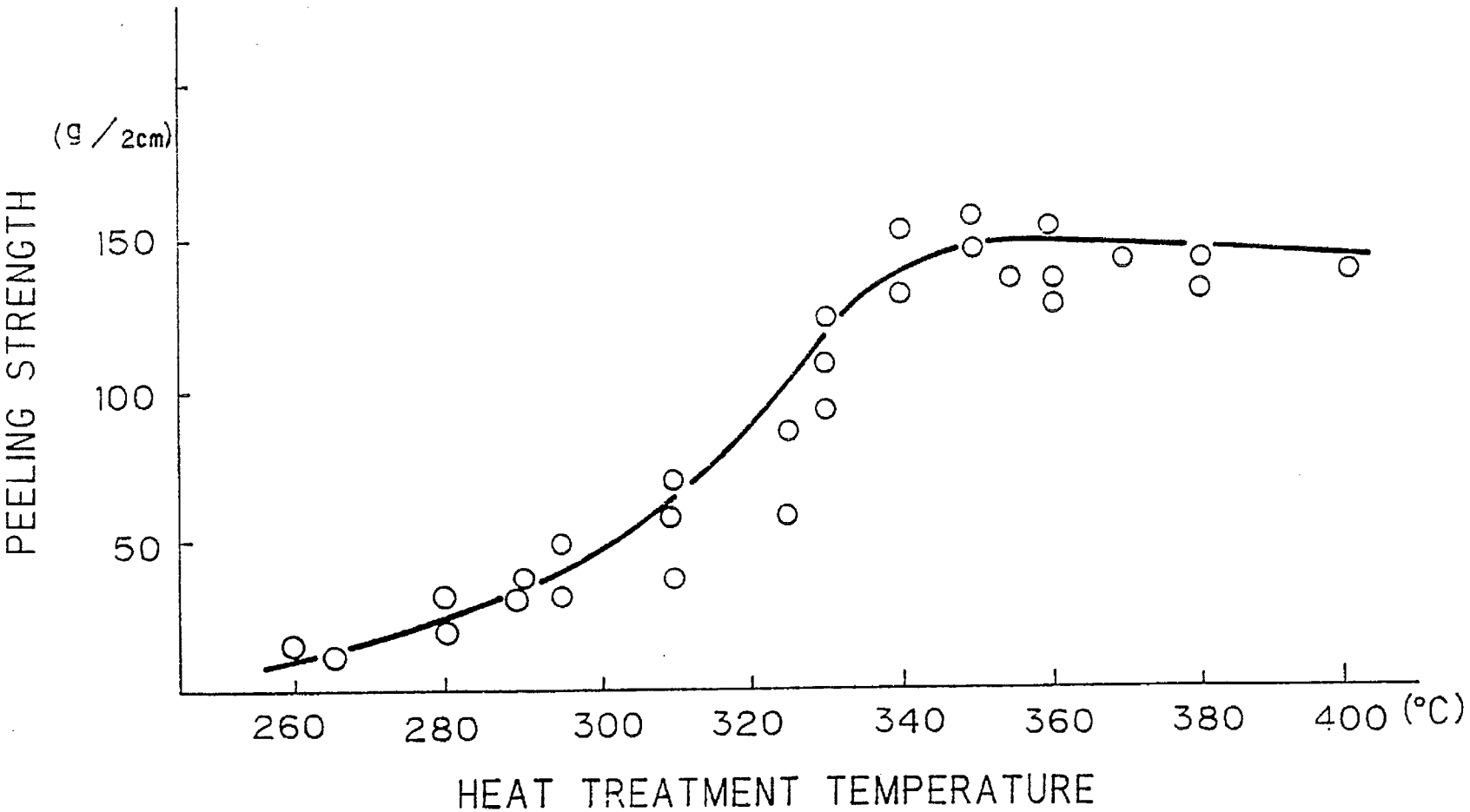
FIG. 3 shows a relationship between a heat treatment temperature applied to coated fibers and a peeling strength of aramide fibers and a fluorine-containing polymeric material layer formed on the aramide fiber surfaces.
Figure 4A:
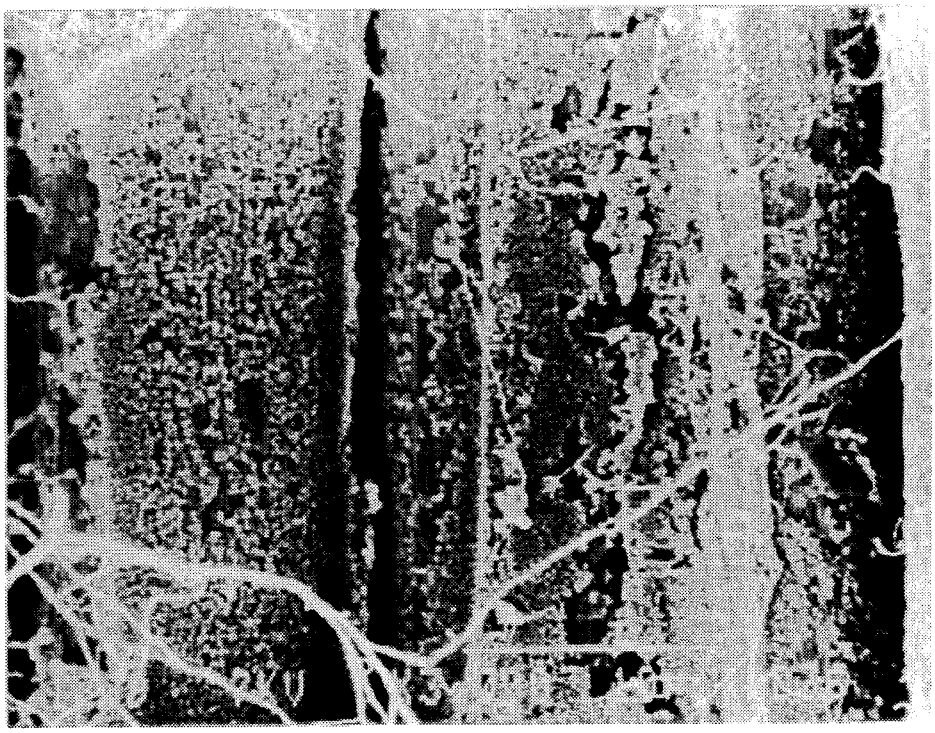
FIGS. 4A, 4B, 4C, 4D and 4E respectively show an electron microscope photograph of a surface of a heat treated, coated aramide fiber respectively corresponding to points A, B, C, D, and E in FIG. 2.
Figure 4B:
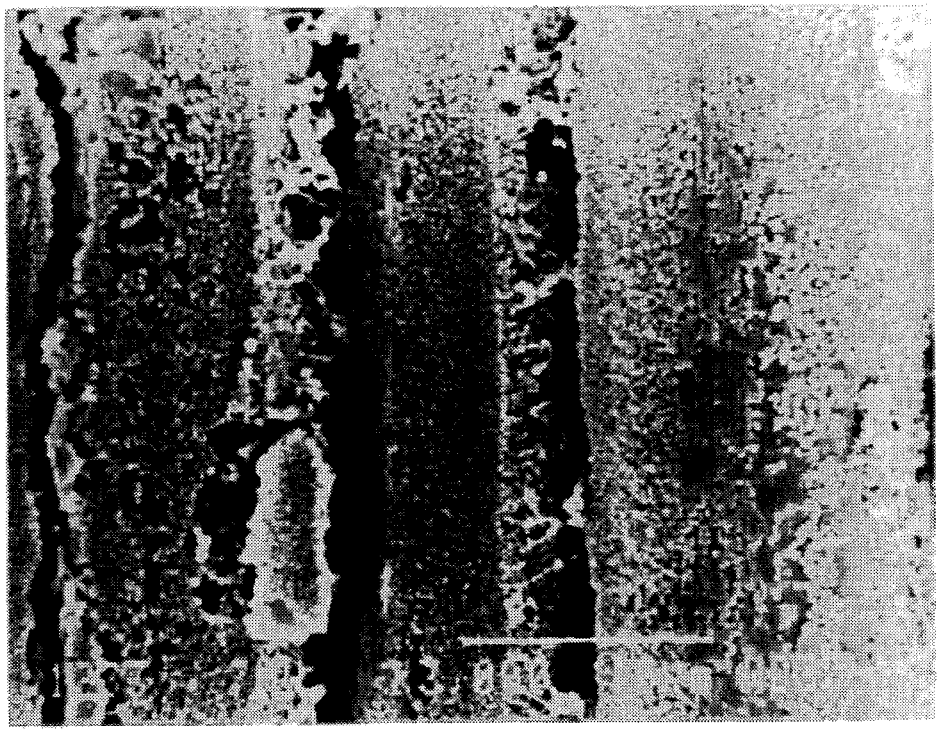
Figure 4C:
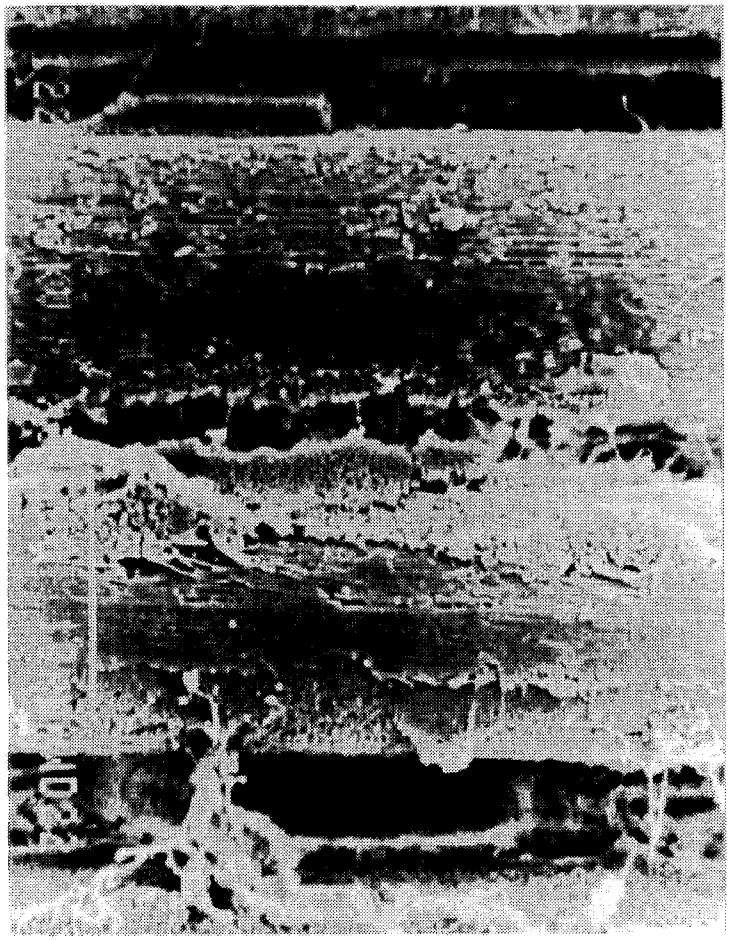
Figure 4D:
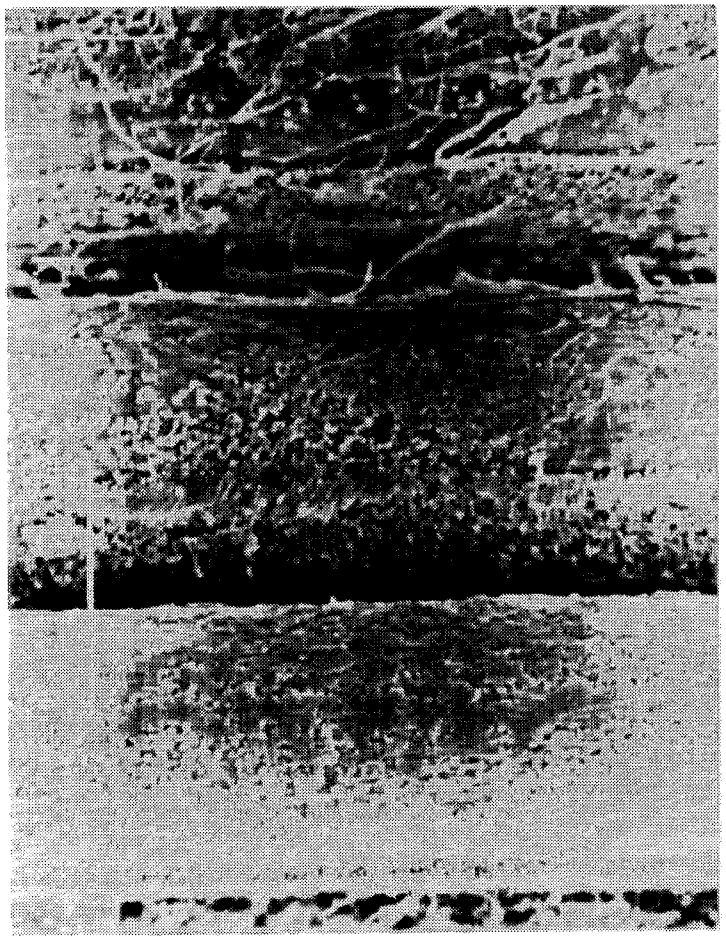
Figure 4E:
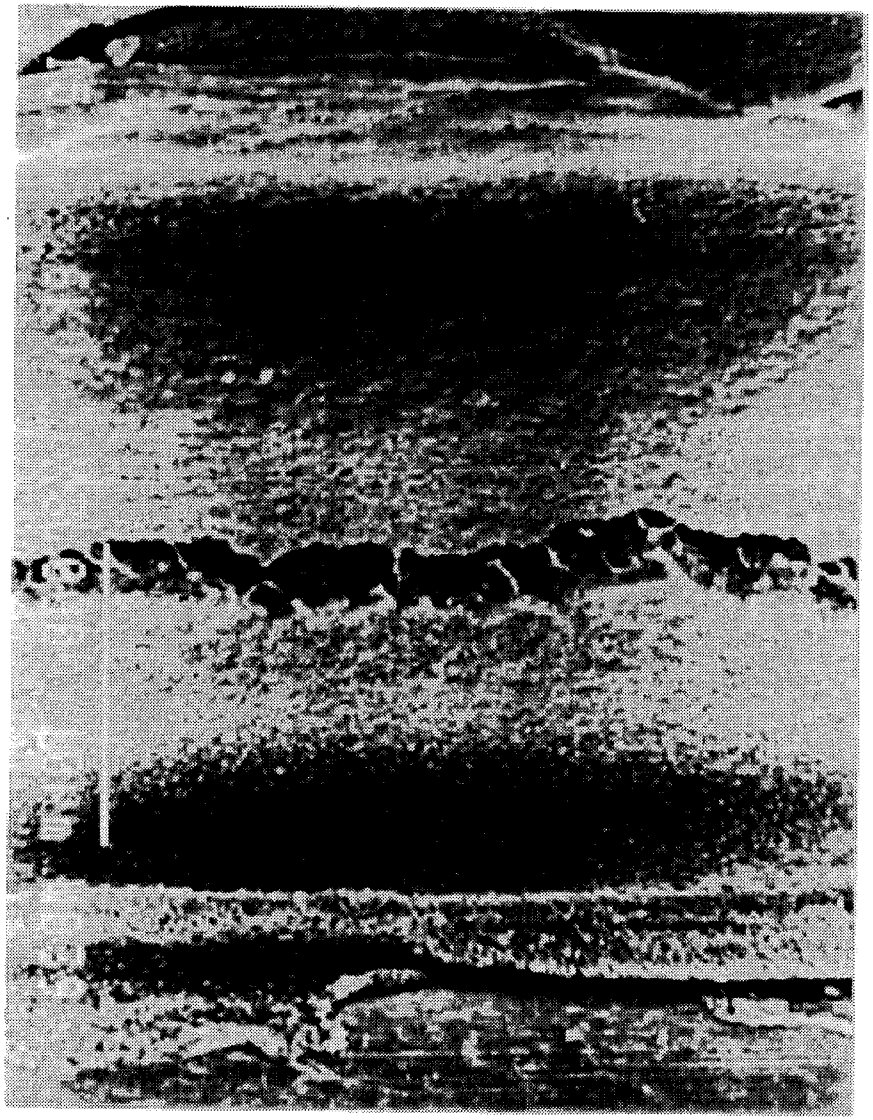

The results are shown in FIG. 3. Namely, FIG. 3 shows that, in the heat treatment temperature range of from about 260° C. to about 350° C., the peeling strength of the resultant test pieces is increased, and in the heat treatment temperature range of more than about 350° C., the peeling strength is constant.

FIGS. 2 and 3 indicate that the individual particles of the fluorine-containing polymeric material on the individual fiber surfaces must be heat-treated at a temperature of from 60° C. above to 60° C. below the melting point of the fluorine-containing polymeric material, so that the individual particles can be firmly fixed to the individual fiber surfaces while maintaining the individual particles in the spherical or semispherical form, and serve as rollers or runners.

EXAMPLE 5

The same procedures as mentioned in Example 3 were carried out with the following exceptions.

The yarns used were wholly aromatic polyester multifilament yarns having a yarn count of 1500 denier/300 filaments.

The heat treatment time was shortened to 2.0 minutes.

The polytetrafluoroethylene was replaced by a tetrafluoroethylene-hexafluoropropylene copolymer having a melting point of 270° C. The aqueous dispersion contained the copolymer in the concentration shown in Table 1.

The results of the tests are shown in Table 1.

EXAMPLE 6

A belt structure was produced by weaving warp yarns consisting of the same aramide multifilament yarns as mentioned in Example 1 and weft yarns consisting of aramide multifilament yarns having a yarn count of 400 denier/267 filaments at a warp density of 85 yarns/25.4 mm and a weft density of 24 yarns/25.4 mm. The belt structure had a width of about 20 mm and a thickness of 1.5 mm.

The belt structure was impregnated with the aqueous dispersion of polytetrafluoroethylene as indicated in Table 1, lightly squeezed, dried at the temperature for the time as indicated in Table 1, and heat treated under the conditions as indicated in Table 1.

The results of the tests are shown in Table 1.

EXAMPLE 7

The same procedures as mentioned in Example 3 were carried out, except that the aqueous dispersion contained 20% by weight of a tetrafluoroethylene-hexafluoropropylene copolymer, and the drying and heat treatment procedures were carried out under the conditions shown in Table 1.

The results of the tests are shown in Table 1.

EXAMPLE 8

An E-type glass filament yarn having a yarn count of 135 tex/800 filaments was impregnated with the aqueous dispersion containing 15% by weight of a trifluoro-chloroethylene polymer having a melting point of 210° C., and dried and heat treated under the conditions shown in Table 1.

Two of the resultant heat treated, coated glass yarns were doubled and twisted at a twist number of 16 turns/10 cm in the Z direction, and three of the Z-twisted glass yarns were paralleled and twisted at a twist number of 12 turns/10 cm in the S direction to provide a glass cord structure having a thickness of about 810 dex.

The results of the tests are shown in Table 1.

EXAMPLE 9

The same procedures as mentioned in Example 8 were carried out, except that a carbon multifilament yarn having a yarn count of 198 rex/3000 filaments was used for the glass yarn, the aqueous dispersion contained 15% by weight of an ethylene-tetrafluoroethylene copolymer having a melting point of 260° C., and the drying and heat treatment procedures were carried out under the conditions indicated in Table 1.

The resultant carbon cord structure had a thickness of about 790 tex.

The results of the tests are shown in Table 1.

Comparative Example 1

The same procedures as in Example 1 were carried out except that the coating procedures with the polytetrafluoroethylene were omitted.

The results of the tests are shown in Table 1.

Comparative Example 2

The same procedures as in Example 6 were carried out except that the coating procedures with the polytetrafluoroethylene were omitted.

The results of the tests are shown in Table 1.

Comparative Example 3

The same procedures as in Example 5 were carried out except that the coating procedures for the wholly aromatic polyester cord structure with the tetrafluoroethylene-hexafluoropropylene copolymer were omitted.

The results of the tests are shown in Table 1.

Comparative Example 4

The same procedures as in Example 8 were carried out except that the procedures for coating the glass cord structure with the trifluorochloroethylene were omitted.

The results of the tests are shown in Table 1.

Comparative Example 5

The same procedures as in Example 9 were carried out except that the procedures for coating the carbon cord structure with the ethylene-tetrafluoroethylene copolymer were omitted.

The results of the tests are shown in Table 1.

Comparative Examples 6 to 8

In each of Comparative Examples 6 to 8, the same procedures as in Example 3 were carried out except that the aqueous dispersion contained polytetrafluoroethylene in the concentration as shown in Table 1 and the heat treatment was carried out under the conditions as shown in Table 1.

The results of the tests are shown in Table 1.

TABLE 1

| Item | | | Aqueous dispersion of fluorine-containing polymer | | Type of fiber structure | Drying | | Heat treatment | | Amount of polymer | Abrasion resistance | | Flexural fatigue resistance | | |
|---|---|---|---|---|---|---|---|---|---|---|---|---|---|---|---|
| Example No. | Type of fiber | Type of fiber structure | Type of polymer | Concentration (% wt) | to be coated | Temperature (°C.) | Time (min) | Temperature (°C.) | Time (min) | on fiber (% wt) | The number of flexural abrasions | Retension of tensile strength (%) | Retension of tensile strength (%) | Flame retardance Oxygen index (%) | Surface covering (SCP) (%) |
| Example 1 | Aramide | Cord | Polytetrafluoroethylene | 1.0 | Cord | 130 | 5.0 | 340 | 3.0 | 0.5 | 750 | — | 54.4 | — | 45 |
| Example 2 | " | " | Polytetrafluoroethylene | 20 | " | 130 | 5.0 | 340 | 3.0 | 6.7 | 3280 | — | 64.8 | — | 52 |
| Example 3 | " | " | Polytetrafluoroethylene | 30 | Yarn | 130 | 4.0 | 330 | 2.5 | 12.8 | 3850 | — | 71.6 | 28.2 | 68 |
| Example 4 | " | " | Polytetrafluoroethylene | 20 | " | 130 | 4.0 | 330 | 3.0 | 12.9 | 4050 | — | 79.3 | 28.4 | 59 |
| Example 5 | Wholly aromatic polyester | " | Tetrafluoroethylene-hexafluoropropylene copolymer | 15 | " | 130 | 4.0 | 320 | 2.0 | 5.1 | 4150 | — | 74.9 | 27.8 | 62 |
| Example 6 | Aramide | Belt | Polytetrafluoroethylene | 50 | Belt | 130 | 10 | 330 | 3.0 | 20.5 | — | 65 | — | — | 48 |
| Example 7 | Aramide | Cord | Tetrafluoroethylene-hexafluoropropylene copolymer | 20 | Yarn | 130 | 5.0 | 280 | 2.5 | 6.8 | 2310 | — | 60.5 | 28.8 | 71 |
| Example 8 | Glass | " | Trifluorochloroethylene polymer | 15 | Yarn | 130 | 5.0 | 200 | 3.0 | 8.7 | 470 | — | 38.2 | — | 68 |
| Example 9 | Carbon | " | Ethylene-tetrafluoroethylene copolymer | 15 | " | 130 | 4.0 | 260 | 3.0 | 6.2 | 140 | — | — | — | 64 |
| Comparative Example 1 | Aramide | Cord | — | — | — | — | — | — | — | — | 330 | — | 50.0 | 24.0 | — |
| Comparative Example 2 | " | Belt | — | — | — | — | — | — | — | — | — | 12 | — | — | — |
| Comparative Example 3 | Wholly aromatic polyester | Cord | — | — | — | — | — | — | — | — | 1800 | — | 63.5 | 24.5 | — |
| Comparative Example 4 | Glass | " | — | — | — | — | — | — | — | — | — | 65 | 14.6 | — | — |
| Comparative Example 5 | Carbon | " | — | — | — | — | — | — | — | — | — | 24 | — | — | — |
| Comparative Example 6 | Aramide | Cord | Polytetrafluoroethylene | 20 | Yarn | 130 | 4.0 | 410 | 2.5 | 11.5 | 1210 | — | 59.8 | — | 29 |
| Comparative | " | " | Polytetrafluo- | 20 | " | 130 | 4.0 | 420 | 2.5 | 12.2 | 1050 | — | 57.8 | — | 23 |

TABLE 1-continued

| Item | | | Aqueous dispersion of fluorine-containing polymer | | Type of fiber structure | Drying | | Heat treatment | | Amount of polymer | Abrasion resistance | | Flexural fatigue resistance | | |
|---|---|---|---|---|---|---|---|---|---|---|---|---|---|---|---|
| Example No. | Type of fiber | Type of fiber structure | Type of polymer | Concentration (% wt) | to be coated | Temperature (°C.) | Time (min) | Temperature (°C.) | Time (min) | on fiber (% wt) | The number of flexural abrasions | Retension of tensile strength (%) | Retension of tensile strength (%) | Flame retardance Oxygen index (%) | Surface covering (SCP) (%) |
| Example 7 | " | " | roethylene | 20 | " | 130 | 4.0 | 430 | 2.5 | 11.8 | 850 | — | 55.7 | — | 13 |
| Comparative Example 8 | | | Polytetrafluo-roethylene | | | | | | | | | | | | |

I claim:

1. A process for producing an abrasion resistant coated fiber structure, comprising the steps of:

preparing and treating liquid containing polytetrafluoroethylene as a polymeric material by:

a) emulsifying fine particles of a solution of the polymeric material in a solvent by using an emulsifying agent, in a liquid medium, or b) dispersing fine solid particles of the polymeric material in a liquid medium;

applying the treating liquid to a fiber structure comprising a number of individual fibers having a thermal decomposition temperature of 230° C. or more, to provide layers of the treating liquid in a total dry amount of 0.5 to 80% by weight based on the total amount of the individual fibers;

drying the treating liquid layers on the individual fibers at a temperature of 80° C. or more; and heat-treating the resultant dried fluorine-containing polymeric layers on the individual fibers at a temperature of from 280° C. up to but not including 370° C., to provide coating layers covering and fixed to the surfaces of the individual fibers at an average surface-covering percentage of 35% or more, the coating layers having a number of individual polymeric material particles fixed with the appearance of herring roe to the individual fiber surfaces.

2. The process as claimed in claim 1, wherein the individual fibers are selected from the group consisting of wholly aromatic polyamide fibers and wholly polyester fibers.

3. The process as claimed in claim 1, which is in the form of a rope or thread.

4. The process as claimed in claim 1, wherein the average surface-covering percentage of the coating layers on the individual fibers is at least 45%.

5. The process as claimed in claim 1, wherein the size of the individual particles of the polymeric material is ⅓ or less than the diameter of the individual fibers.

6. The process as claimed in claim 5, wherein the size of the individual particles of the polymeric material is from 0.1 μm to 1.0 μm.

* * * * *